US008528238B2

(12) United States Patent
Skjæveland

(10) Patent No.: US 8,528,238 B2
(45) Date of Patent: Sep. 10, 2013

(54) WEAR PART DEVICE FOR A WORK TOOL

(75) Inventor: Magne Skjæveland, Klepp St. (NO)

(73) Assignee: Kverneland Group Operations Norway AS, Kvernaland (NO)

( * ) Notice: Subject to any disclaimer, the term of this patent is extended or adjusted under 35 U.S.C. 154(b) by 0 days.

(21) Appl. No.: 13/516,374

(22) PCT Filed: Dec. 15, 2010

(86) PCT No.: PCT/NO2010/000461

§ 371 (c)(1),
(2), (4) Date: Jul. 26, 2012

(87) PCT Pub. No.: WO2011/074983

PCT Pub. Date: Jun. 23, 2011

(65) Prior Publication Data

US 2012/0279096 A1 Nov. 8, 2012

(30) Foreign Application Priority Data

Dec. 17, 2009 (NO) ..... 20093547

(51) Int. Cl.
*E02F 9/26* (2006.01)

(52) U.S. Cl.
USPC ..... 37/455

(58) Field of Classification Search
USPC ..... 37/446, 452–458; 172/749, 750, 172/757, 677, 683, 698, 699, 701.2, 701.3, 172/713, 719, 720, 721, 753, 772, 772.5
See application file for complete search history.

(56) References Cited

U.S. PATENT DOCUMENTS

| | | | | |
|---|---|---|---|---|
| 3,736,676 | A | 6/1973 | Sturgeon | |
| 4,269,274 | A | 5/1981 | Robertson et al. | |
| 4,754,816 | A | 7/1988 | Edmission | |
| 6,607,040 | B2 * | 8/2003 | Skjaeveland | 172/749 |

FOREIGN PATENT DOCUMENTS

| | | |
|---|---|---|
| EP | 1 259 105 B1 | 4/2006 |
| GB | 865840 | 4/1961 |
| WO | WO 2009/082317 A1 | 7/2009 |

* cited by examiner

*Primary Examiner* — Robert Pezzuto
(74) *Attorney, Agent, or Firm* — Foley & Lardner LLP

(57) ABSTRACT

A replaceable wear part device for attachment on a forward edge of a work tool includes at least a portion of the forward edge of the work tool that has an attachment section having spaced engagement surfaces. The wear part device has a complimentary attachment section provided with spaced engagement surfaces in which the respective engagement surfaces may mutually and slidably engage to hold the wear part device attached to the work tool. The wear part device has an elongated eminence arranged crosswise to the intended operating direction of the work tool, and immediately forward of the attachment section of the wear part. The eminence extends laterally across a first sliding surface by a distance at least equal to a distance between the mutually engaged engagement surfaces.

5 Claims, 2 Drawing Sheets

WEAR PART DEVICE FOR A WORK TOOL

FIELD OF THE INVENTION

The invention relates to a replaceable wear part device for attaching to the forward edge of a work tool, where at least a portion of the forward edge is formed by a wear part holder, as the wear part is provided with a first sliding surface, and the wear part holder is provided with a second sliding surface, which is essentially arranged as an extension of said first sliding surface, and the second sliding surface is provided with a forward sliding edge surface defining the sliding surface against the wear part, more particularly by an eminence on the first sliding surface arranged to be able to lead a material flow away from at least a portion of the wear part holder's sliding surface.

BACKGROUND

From work tools provided with an edge, rim, prong, tooth or the like arranged to be able to work against and move uncompacted material such as earth, gravel, pebbles etc., it is known to use replaceable wear parts to increase the working life of the portion/portions being exposed to hard wear. The applicant's own patent publication EP 1259105 discloses such a wear part for fitting to a forward edge of a work tool, as a holder is arranged on the work tool and forms at least a portion of the forward edge, and the wear part is provided with cooperating guide elements forming a slidable fit of the bell-and-spigot type for quick replacement of the wear part without the use of attachment means or other means than a hitting tool. EP 1259105 is in its entirety included in this description as a reference.

It has turned out that on some types of tools, such as ploughs and cultivators, said wear part holder is exposed to as high wear as the wear part itself. In such situations the benefit of a replaceable wear part is lost by the very fact that the wear part and the wear part holder has the same working life and must be replaced simultaneously.

SUMMARY

The object of the invention is to remedy or reduce at least one of the disadvantages of the prior art, or at least provide a useful alternative to prior art.

The object is achieved by the features disclosed in the below description and in the subsequent claims.

In the following the term "length" unless otherwise expressly said, is to be understood as the extent of en element in the operative direction of movement of a wear part when the wear part is arranged on the forward edge of a work tool, and possibly the extent of an axis lying in a plane coincident with said direction of movement. The term "width", unless otherwise expressly said, is then to be understood as the extent of the element perpendicularly to said plane coincident with the operational direction of movement of the wear part. By the term "height", unless otherwise expressly said, is then to be understood as the extent of the element upward from a plane coincident with that side face on the wear part that the element is arranged on.

On a wear part for a forward edge on a work tool provided with an edge, rim, prong, tooth or the like arranged to be able to work against and move uncompacted material such as earth, gravel, pebbles etc., there is on a sliding face tilted relative to and facing in the operative direction of movement of the wear part, at least partly crosswise to said direction of movement and spaced from the delimitation of the sliding surface against the corresponding sliding face of a wear part holder arranged an extended ridge, in the following also called an eminence. The eminence extends at least over a part of the width of the sliding surface and is advantageously arranged perpendicularly to said operative direction of movement. The width-wise extent of the eminence is at least as large as the width-wise extent of contact surfaces arranged between the wear part and the adjacent wear part holder. The height of the eminence over the sliding surface is preferably at least 10 mm, and advantageously at least 12 mm. At least against the front of the wear part, the back exhibits preferably a tilted side face. The eminence is advantageously arranged as close to the wear part holder as technically possible, as a rear side face of the wear part defines the eminence.

Through extensive test operation it has surprisingly turned out that said ridge has a very positive effect on the working life of the wear part holder relative to the wear part without the working life of the wear part being impaired. The effect is most probably due to the ridge leading the material flow to a sufficient degree away from the proximal, downstream sliding surfaces and also the interconnecting parts between the wear part and the wear part holder, so that these to a lesser extent come into contact with the material flow. In adhesive earth masses some earth builds up on a portion downstream of the eminence, an indication that the material flow pressure against the sliding surfaces has been greatly reduced. By making the eminence of a material having at least as good wear properties as the rest of the wear part, the eminence maintains its protective effect in a large part of the working life of the wear part, as the working life of the wear part in the main is determined by how fast it is shortened down by wearing down of the forward edge of the wear part.

More particularly the invention relates to a replaceable wear part device for a work tool for attaching on a forward edge of a work tool, where at least a portion of the forward edge is formed by a wear part holder, as the wear part is provided with a first sliding surface, and the wear part holder is provided with a second sliding surface essentially arranged as an extension of said first sliding surface, and the second sliding surface being provided with a forward sliding surface edge defining the sliding surface against the wear part, characterized in that on the first sliding surface is arranged an eminence arranged to be able to lead a material flow away from at least a portion of the sliding surface of the wear part holder.

The eminence may have an extension essentially cross-wise the operative direction of movement of the work tool. This gives better utilisation of the wear part material without the sliding surface properties of the wear part being impaired worth mentioning.

The cross-wise extension of the eminence may at least be coincident with a width-wise extension of fastening elements arranged on the wear part holder and the wear part. Protection of portions of the wear part and the wear part holder being of essential significance for the fastening of the wear part in the work tool is thereby achieved.

The eminence may be provided with a front surface tilting in the operative direction of movement of the work tool from an eminence top toward the first side surface. Thereby is provided an inclined plane improving the material flow over the wear part.

The eminence may exhibit a height from the first side surface to the eminence top of minimum 10 mm, and more advantageously minimum 12 mm. This has turned out to give sufficient effect on the working life of the wear part holder without impairing worth mentioning the material flow over the wear part.

The eminence may be arranged adjacent a rear edge of the wear part. Such a positioning gives a maximum extension of the area of the wear part holder being influenced by the eminence.

BRIEF DESCRIPTION OF THE DRAWINGS

In the following is described an example of a preferred embodiment illustrated in the accompanying drawings, wherein.

DETAILED DESCRIPTION

Figure 1:
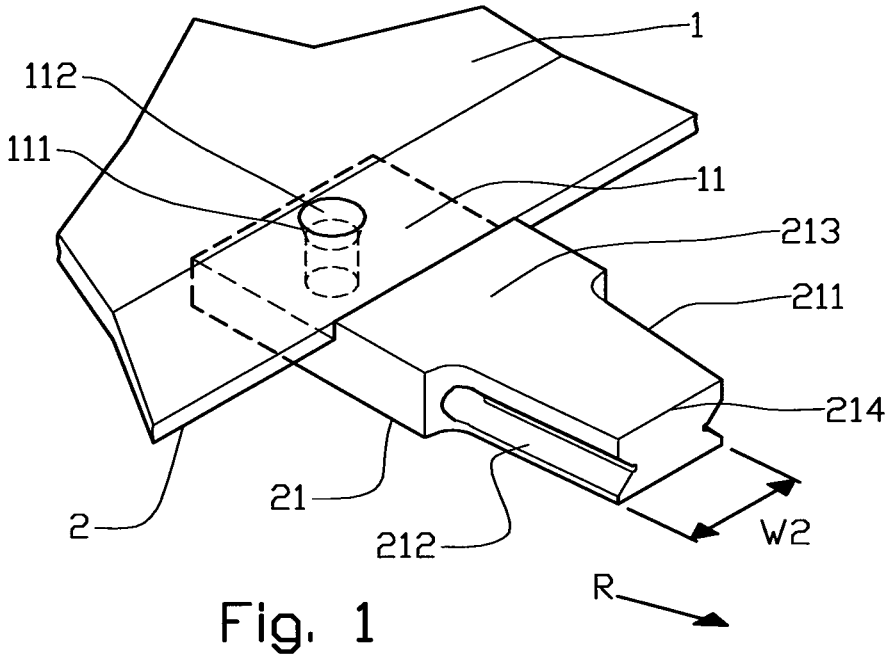
FIG. 1 shows a section of a forward edge on a schematically pictured work tool in perspective, where a wear part holder is attached.
Figure 2:
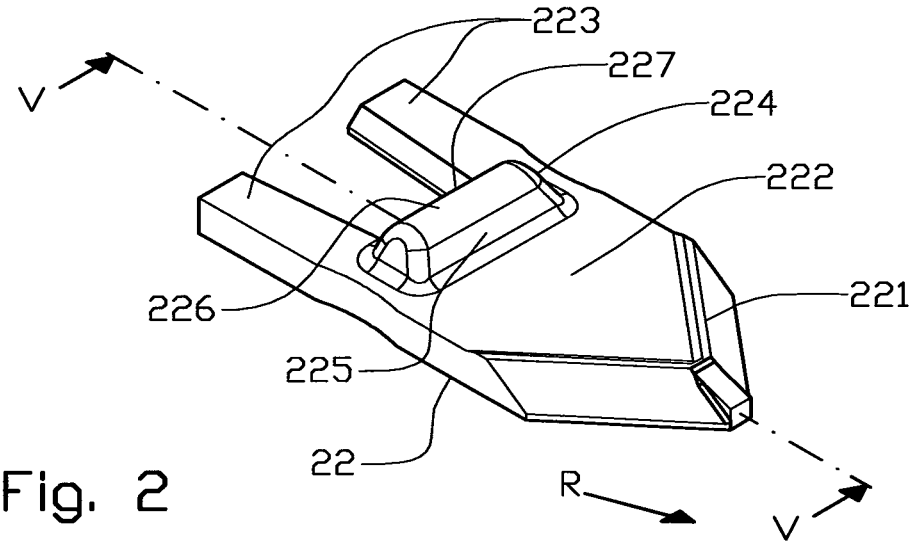
FIG. 2 shows a wear part according to the invention in perspective.
Figure 3:
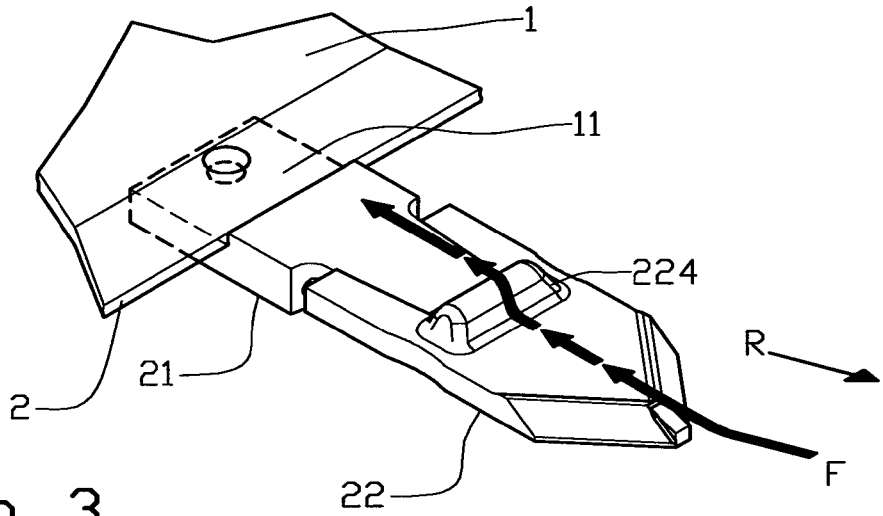
FIG. 3 shows at a smaller scale a perspective view of an assembled work tool having a wear part of the invention.

Referring now to the drawings in the following, there will now be described preferred embodiments of a replaceable wear part of the invention adapted for fitting on a work tool having one or more, working forward edges or fronts arranged to be able to work in a specific material, and which is exposed to wear over time.

The preferred embodiment examples being described are associated with earth working tools for use in agriculture, but it is to be understood that the invention has further application, as it may be used on replaceable working blades of per se known kind, and for other types and combinations of working tools requiring fitting of replaceable working blades held on by a wear part holder whose working life is desired prolonged.

On a working tool 1 is formed an attachment portion 11 for a replaceable forward edge element 2. The edge element 2 may be formed as a blade or shear on a plough or as a leveling blade, a jaw on an excavator bucket, an end portion on a cultivator prong etc. On the edge element 2 is integrated a wear part holder 21, shown here attached to the working tool 1 by means of an attachment bolt 112 led through a portion of the wear part holder 21 and the edge element 2. The wear part holder 21 is provided with a spigot 211 comprising profiled contact faces 212 arranged to engage a corresponding attachment portion 223 on a replaceable wear part 22. The wear part holder 21 is provided with a sliding surface 213 defined against the wear part 22 by a forward sliding surface edge 214.

The replaceable wear part 22 is provided with a front portion 221, which in the embodiment example shown has the shape of an apex arranged to be able to easily penetrate down into a mass in which the work tool 1 is to be displaced. The wear part 22 is provided with a sliding surface 222 extending in a plane approximately in plane with the sliding surface 213 of the wear part holder 21 and which during the normal working direction R of the working tool 1 is arranged downstream of the wear part 22.

An eminence 224 protrudes up from a rear portion of the sliding surface 222 of the wear part 22 and is downstream defined by a rear edge 227 by the wear part 22 formed at the root of the attachment portion 223.

Figure 4:
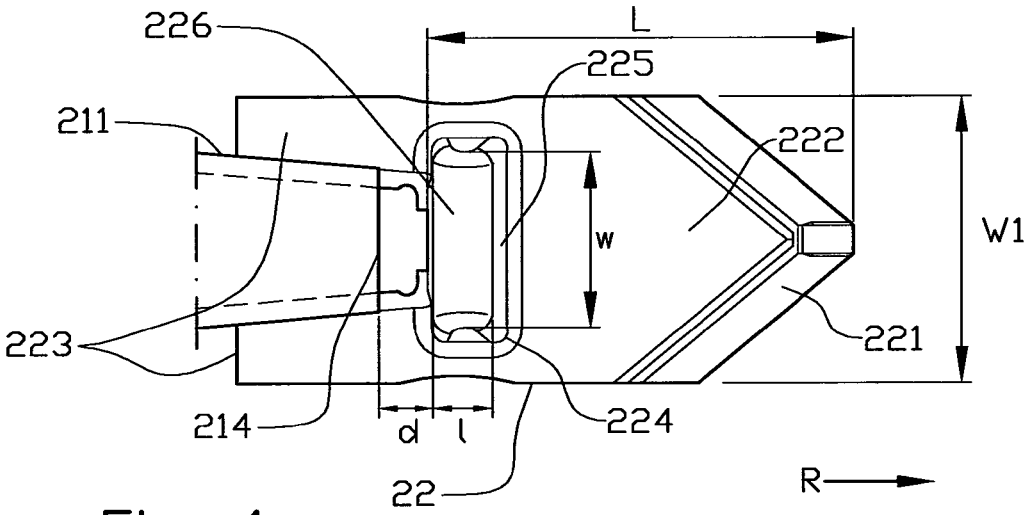
FIG. 4 shows at a larger scale a plan view of the wear part and also a section of the wear part holder socket.
Figure 5:
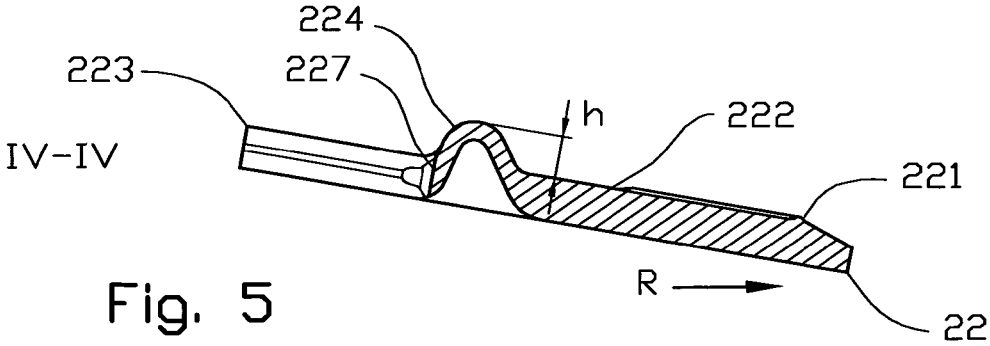
FIG. 5 shows a longitudinal section through the wear part as indicated V-V in FIG. 2.

The width of the wear part is indicated by reference W1 and its defined length is shown as L (see FIG. 4). The width of the spigot is called W2 (see FIG. 1).

The wear part eminence 224 has the following dimensions (see FIG. 4):

the width-wise extent of the eminence 224=w the length-wise extent of the eminence 224=l the height of the eminence 224 above the wear part sliding surface=h the distance of the eminence 224 from the wear part holder forward sliding surface edge 214=d.

The eminence 224 is shown here arranged in the wear part 22 by hot forming, as the eminence 224 is forced out by a for the purpose suitable tool from the underside of the wear part 22.

The eminence 224 has a width-wise extent w surpassing the width W2 of the spigot 211 for thereby to form a protection for at least the spigot 211 and parts of the attachment portions 223 of the wear part 22, as the proximal parts of the wear part holder 21 and also said, adjacent attachment portions 223 of the wear part 22 are left lying to the lee downstream of the eminence 224.

A material flow over the sliding surfaces 213, 222 of the wear part 22 and the wear part holder 21 is indicated with arrows F. The effect of the eminence 224 is shown by the change of direction of the arrow F.

The embodiment example shown is adapted to a production technology utilizing forging, as the eminence 224 has rounded shapes on all projecting sides. The eminence is by this production method not carried all the way out to the sides of the wear part 22 to maintain sufficient material thickness in these portions of the wear part 22 cross-section. In other production technology, such as in forming by machining and welding, other shapes of the eminence 224 will be relevant without this falling outside the scope of the invention.

The invention claimed is:

1. A replaceable wear part device for attachment on a forward edge of a work tool, wherein at least a portion of the forward edge of the work tool comprises an attachment section having spaced engagement surfaces, the wear part device comprising:

a rear edge having an attachment section with spaced engagement surfaces, wherein the attachment section of the wear part device is complementary to the attachment section of the work tool, wherein the respective engagement surfaces are configured to be mutually and slidably engageable so as to hold the wear part device when the wear part device is attached to the work tool, wherein the wear part device further comprises an elongated eminence arranged crosswise to an intended operating direction of the work tool and immediately forward of the attachment section of the wear part, wherein the eminence extends laterally across a first sliding surface by a distance at least equal to a distance between the mutually engaged engagement surfaces, wherein the eminence is configured such that material dislodged by the work tool is deflected by the eminence away from the attachment section of the work tool.

2. The device according to claim 1, wherein the eminence is provided with a front surface tilting in the operating direction of movement of the work tool from a top of the eminence toward the first sliding surface.

3. The device according to claim 1, wherein the eminence exhibits a height from the first sliding surface to a top of the eminence, and wherein the height is at least 10 mm.

4. The device according to claim 1, wherein the eminence exhibits a height from the first sliding surface to a top of the eminence, and wherein the height is at least 12 mm.

5. The device according to claim 1, wherein the eminence is arranged adjacent to the rear edge of the wear part device, and wherein the rear edge forms an abutment for the attachment section of the work tool.

* * * * *